US009316235B2

(12) United States Patent
Tanaka

(10) Patent No.: US 9,316,235 B2
(45) Date of Patent: Apr. 19, 2016

(54) PRESSURIZED LIQUID LIFTING DEVICE AND LIQUID LIFTING METHOD

(71) Applicant: Murata Manufacturing Co., Ltd., Kyoto (JP)

(72) Inventor: Nobuhira Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 14/801,873

(22) Filed: Jul. 17, 2015

(65) Prior Publication Data

US 2015/0322970 A1 Nov. 12, 2015

Related U.S. Application Data

(63) Continuation of application No. PCT/JP2013/083302, filed on Dec. 12, 2013.

(30) Foreign Application Priority Data

Jan. 18, 2013 (JP) ..... 2013-006823

(51) Int. Cl.
*F04F 1/06* (2006.01)
*F04D 17/10* (2006.01)
(Continued)

(52) U.S. Cl.
CPC . *F04F 1/06* (2013.01); *F04D 13/16* (2013.01); *F04D 17/10* (2013.01); *F04B 23/028* (2013.01)

(58) Field of Classification Search
CPC ..... F04F 1/00; F04F 1/06; F04F 1/08; F04F 1/18; E21B 43/121; F04D 17/10; F04D 13/16; F04B 47/00; F04B 23/02; F04B 23/028; F04B 41/02
USPC ..... 417/118, 384, 53, 108, 109; 137/206, 137/209, 155, 156, 176; 43/121
See application file for complete search history.

(56) References Cited

U.S. PATENT DOCUMENTS 298,990 A * 5/1884 Leedy ..... F04F 1/06 417/118
487,639 A * 12/1892 Pohle ..... F04F 1/18 417/108

(Continued)

FOREIGN PATENT DOCUMENTS

JP 2003-013899 A 1/2003
JP 2012-011304 A 1/2012
JP 4932231 B2 5/2012

OTHER PUBLICATIONS

International Search Report issued in Application No. PCT/JP2013/083302 dated Mar. 18, 2014.

(Continued)

*Primary Examiner* — Devon Kramer
*Assistant Examiner* — Nathan Zollinger
(74) *Attorney, Agent, or Firm* — Pearne & Gordon LLP

(57) ABSTRACT

A liquid lifting device includes: a liquid lifting tank storing liquid; an air pump pressurizing the interior of the liquid lifting tank; a liquid lifting pipe connecting the liquid lifting pipe to the liquid lifting tank having a liquid delivery port in the other end that stands upright; an air supply pipe in which one end portion of the air supply pipe connected to a branching section provided at a position halfway in the liquid lifting pipe and an upright section provided in the other end portion thereof; an air valve that is provided on the other end portion of the air supply pipe; and a liquid storage section that is formed in part of the liquid lifting pipe at a position between the liquid delivery port and the branching section and that is positioned below the branching section.

6 Claims, 5 Drawing Sheets

(51) Int. Cl.
*F04D 13/16* (2006.01)
*F04B 23/02* (2006.01)

(56) References Cited

U.S. PATENT DOCUMENTS 580,540 A * 4/1897 Apgar ..... F04F 1/18 417/108
779,941 A * 1/1905 Hughes ..... F04F 1/18 417/108
1,154,745 A * 9/1915 Browne ..... F03D 9/001 417/108
1,537,264 A * 5/1925 Rogers ..... F04F 1/18 220/DIG. 32
1,597,664 A * 8/1926 Gaskell ..... F04F 1/12 137/124
1,741,571 A * 12/1929 Ives ..... F04F 1/00 417/108
1,811,295 A * 6/1931 Blow ..... F04F 1/12 417/108
2,014,613 A * 9/1935 Ceverha ..... F04F 10/02 417/383
4,519,749 A * 5/1985 Baumberg ..... F04F 9/00 417/108
4,573,877 A * 3/1986 Baumberg ..... F03D 5/00 417/108
4,579,511 A * 4/1986 Burns ..... E21B 43/122 417/109
4,583,918 A * 4/1986 Baumberg ..... F03D 9/007 417/108
4,630,753 A * 12/1986 Anscherlik ..... G01F 11/28 222/17
4,671,741 A * 6/1987 Baumberg ..... F04F 3/00 417/108
4,801,246 A * 1/1989 Baumberg ..... F04F 1/04 126/636
5,186,611 A * 2/1993 Frandsen ..... F04F 1/06 415/182.1
6,234,761 B1 * 5/2001 Kocsis ..... E21B 43/121 417/118
6,474,356 B2 * 11/2002 Bouwkamp ..... E02B 7/18 137/142
6,976,497 B2 * 12/2005 Gridley ..... F04F 1/08 137/14
8,403,033 B2 * 3/2013 Ahern, Jr. ..... E03B 3/16 166/105

OTHER PUBLICATIONS

Translation of Written Opinion issued in Application No. PCT/JP2013/083302 dated Mar. 18, 2014.

* cited by examiner

PRESSURIZED LIQUID LIFTING DEVICE AND LIQUID LIFTING METHOD

BACKGROUND

Technical Field

The present disclosure relates to pressurized liquid lifting devices and liquid lifting methods configured to lift liquid at a low position to a higher position using a pressurized air pump.

Liquid lifting devices using a pressurized air pump (micro blower) are a device, as shown in FIG. 8, in which one end of a liquid lifting pipe 101 is connected to a sealed tank 100, the other end of the liquid lifting pipe 101 is erected to a higher position, and the interior of the sealed tank 100 is pressurized by an air pump 102 so that liquid in the sealed tank 100 is lifted to a higher position via the liquid lifting pipe 101, for example.

Patent Document 1: Japanese Unexamined Patent Application Publication No. 2012-11304

BRIEF SUMMARY

However, the above liquid lifting device cannot lift liquid to a position equal to or higher than a potential liquid lifting height which corresponds to a maximum discharge pressure generated by the air pump 102. For example, in the case where the liquid is water and a maximum discharge pressure generated by the air pump 102 is 2 kPa, a potential liquid lifting height h0 by the air pump 102 is approximately 20 cm from a liquid surface in the sealed tank 100.

The present disclosure provides a pressurized liquid lifting device and a liquid lifting method using a pressure pump capable of lifting liquid to a height equal to or higher than a potential liquid lifting height of the stated pump.

The present disclosure provides a pressurized liquid lifting device that includes: a liquid lifting tank which has an airtight structure and stores liquid; an air pump that pressurizes the interior of the liquid lifting tank; a liquid lifting pipe in which one end of the liquid lifting pipe communicates with the liquid in the liquid lifting tank, the other end portion of the liquid lifting pipe stands upright, a liquid delivery port is formed in a leading end of the other end portion, and a height from a liquid surface in the liquid lifting tank to the liquid delivery port is larger than a potential liquid lifting height of the above air pump; an air supply pipe in which one end portion of the air supply pipe is connected to a branching section provided at a position halfway in the liquid lifting pipe, and an upright section is provided standing upright in the other end portion thereof; an air valve that is provided on the other end portion of the air supply pipe and that can be opened/closed with respect to the outside air; and a liquid storage section that is formed in part of the liquid lifting pipe at a position between the liquid delivery port and the branching section, positioned below the branching section, and capable of storing a predetermined amount of liquid. Further, in the stated pressurized liquid lifting device, the branching section is provided at a position that is higher than the height of the liquid surface in the liquid lifting tank and lower than the potential liquid lifting height of the air pump.

In the present disclosure, in the case where the air pump is driven to pressurize the interior of the liquid lifting tank in a state where liquid is not stored in the liquid storage section, liquid rises up to a potential liquid lifting height in the liquid lifting pipe. In this case, part of the liquid flows over the branching section and enters the liquid storage section. Next, in the case where the air pump is stopped while the air valve is being opened, because the position of the branching section is higher than the height of the liquid surface in the liquid lifting tank and lower than the potential liquid lifting height of the air pump, the liquid surface in the liquid lifting pipe lowers and an air layer is introduced into the branching section through the air supply pipe so that the liquid in the liquid storage section is separated from the liquid in the liquid lifting pipe on the tank side relative to the branching section by the air layer. In this state, a predetermined amount of liquid is left in the liquid storage section. Subsequently, in the case where the air valve is closed and the air pump is driven, because the air layer present at a position halfway in the liquid lifting pipe is pushed by the liquid having been pushed out of the liquid lifting tank, the liquid left in the liquid storage section is pushed up toward the liquid delivery port on the other end side of the liquid lifting pipe via the air layer and can be discharged through the liquid delivery port. This makes it possible to lift the liquid to a position which is higher than a height (potential liquid lifting height) corresponding to a maximum discharge pressure of the air pump.

Although the liquid storage section can take any shape as desired, a cross-sectional shape of the liquid storage section is required to make it possible to store a predetermined amount of liquid and seal the whole liquid. In other words, the liquid storage section needs to have a function that pushes the liquid stored therein toward a downstream side (liquid delivery port side of the liquid lifting pipe) using the air layer in the liquid lifting pipe. Any type of pump can be used as the air pump. A pump having a structure in which operation of drive/stop can be instantaneously carried out like a piezoelectric blower may be used, and a discharge outlet and a suction inlet communicate with each other when the pump is stopped (a structure without a check valve). This is because the interior of the tank can quickly return to a state under the atmospheric pressure by making the discharge outlet and the suction inlet communication with each other when the pump is stopped, and the efficiency of liquid-lifting can be improved by repeating the operation of drive/stop at a short interval time.

The upright section of the air supply pipe may extend up to a position higher than the potential liquid lifting height of the air pump, and the air valve may be attached to the upright section of the air supply pipe at a position higher than the potential liquid lifting height of the air pump. In this case, even if liquid flows into the air supply pipe for some reason, the liquid will not make contact with the air valve because the position of the air valve is higher than the potential liquid lifting height of the air pump. As such, impurities in the liquid will not adhere to the valve so that the open/close capability of the valve can be maintained over a long period of time. An attachment position of the air valve is not limited to the upright section of the air supply pipe; for example, an upward-facing upright section and a downward-facing section may be continuously formed on the other end portion of the air supply pipe and the air valve may be attached to the downward-facing section. In this case, if an upper end of the upright section is positioned higher than the potential liquid lifting height of the air pump, liquid will not make contact with the air valve because the liquid cannot flow over the upright section.

Although any valve which is capable of carrying out operation of open/close instantaneously and in which air is hardly leaked can be used as the air valve, a check valve that only allows air from the exterior to flow into the air supply pipe may be used. In this case, because the check valve is a passive valve that is automatically opened or closed depending on air pressure in the air supply pipe, open/close control of the air valve is unnecessary and liquid can be lifted by controlling the operation of drive/stop of the air pump.

As a condition for lifting the liquid, it is necessary for a volume of the liquid storage section to be smaller than a product of a cross-sectional area of the liquid lifting pipe and the potential liquid lifting height of the air pump. That is to say;

(Volume of Liquid Storage Section)<(Cross-Sectional Area of Liquid Lifting Pipe)×(Potential Liquid Lifting Height)

By setting the volume of the liquid storage section to be smaller than the product of the cross-sectional area of the liquid lifting pipe and the potential liquid lifting height of the air pump, the liquid in the liquid storage section can be lifted with certainty in the case where the air pump is driven and the liquid surface rises up to the potential liquid lifting height.

As described above, even if the air pump is driven in a state where liquid is not stored in the liquid storage section, liquid is only stored in the liquid storage section in the first driving and therefore cannot be discharged through the liquid delivery port of the liquid lifting pipe. Here, in order to discharge the liquid through the liquid delivery port with certainty in and after the second driving, the following condition may be satisfied. That is to say;

Volume of Air Layer>(Cross-Sectional Area of Liquid Lifting Pipe)×(Difference in Height between Liquid Delivery Port of liquid Lifting Pipe and Liquid Surface in Tank−Potential Liquid Lifting Height)

At a stage where the air layer is introduced into the branching section through the air supply pipe, by making the volume of the air layer larger than a product of the cross-sectional area of the liquid lifting pipe and a value obtained by subtracting the potential liquid lifting height of the air pump from a difference in height between the liquid delivery port of the liquid lifting pipe and the liquid surface in the liquid lifting tank, the liquid can be continuously discharged from the second driving of the air pump. In the case where the above condition cannot be satisfied, the liquid can be continuously discharged by performing no less than three times the driving of the air pump.

As discussed thus far, according to the present disclosure, the air supply pipe having the air valve is connected to the liquid lifting pipe at a position halfway in the liquid lifting pipe via the branching section, and the liquid storage section is provided in the liquid lifting pipe at a position on the liquid delivery port side relative to the branching section. Accordingly, by closing the air valve and driving the air pump after having once stored the liquid in the liquid storage section, the liquid left in the liquid storage section can be pushed up to the liquid delivery port of the liquid lifting pipe. As a result, the liquid can be lifted to a position higher than the potential liquid lifting height of the air pump.

DESCRIPTION OF EMBODIMENTS

First Embodiment

Figure 1:
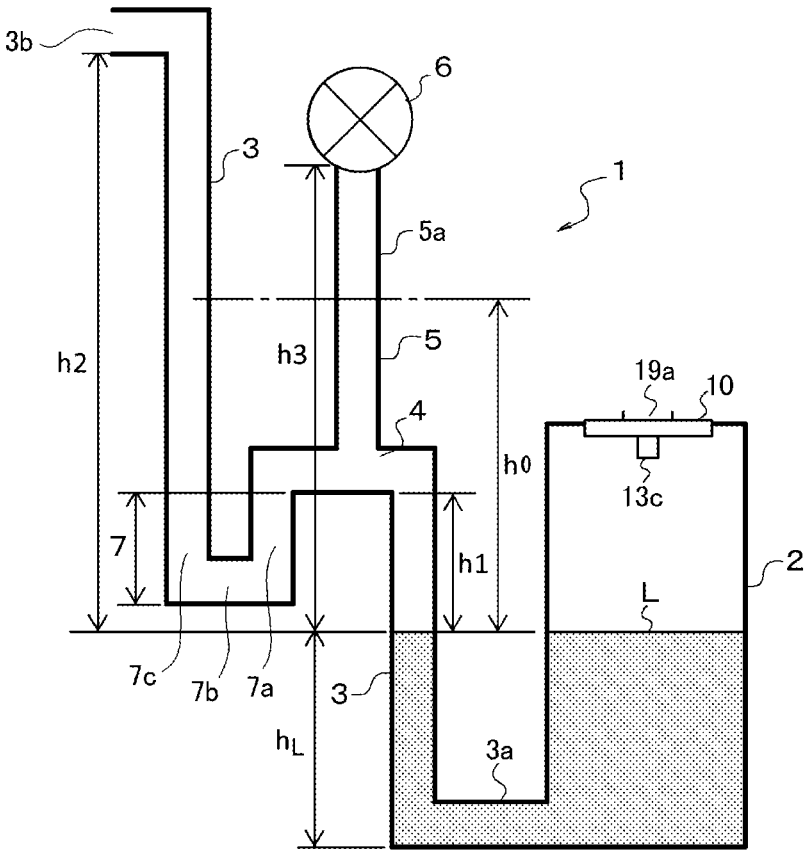
FIG. 1 is a schematic diagram illustrating a first embodiment of a pressurized liquid lifting device according to the present disclosure.

FIG. 1 illustrates a first embodiment of a pressurized liquid lifting device according to the present disclosure. This liquid lifting device 1 includes a liquid lifting tank 2 having an airtight structure and provided at a lower position, and an air pump 10 as a pressure pump provided in the tank 2. Although not illustrated in the drawing, a liquid supply port that can be opened/closed with a cap is provided in the tank 2. A liquid (for example, water) is stored in the tank 2 up to a level lower than a branching section 4, which will be explained later. A suction inlet 19*a* of the air pump 10 is opened to the exterior while a discharge outlet 13*c* is opened to the interior of the tank 2. Details of the air pump 10 will be described later. In the present embodiment, the air pump 10 is attached to an upper wall of the tank 2 so as not to make contact with a liquid L stored in the tank 2.

One end portion 3*a* of a liquid lifting pipe 3 is connected to a bottom portion of the tank 2, the other end portion side thereof stands upright, and a liquid delivery port 3*b* is opened in a leading end of the other end portion thereof. A height difference h2 between a liquid surface in the tank 2 (when the air pump is not driven) and the liquid delivery port 3*b* is larger than a potential liquid lifting height h0 of the air pump 10 from the liquid surface in the tank 2. A cross-sectional area of the tank 2 may be sufficiently larger than that of the liquid lifting pipe 3 (for example, 100 times or more) so that the liquid surface in the tank 2 does not change noticeably between when the air pump 10 is driven and when the air pump 10 is not driven.

The liquid lifting pipe 3 is bent while forming an S shape in an up-down direction, and the branching section 4 configured to branch into two segments is provided at a position halfway in the pipe. The branching section 4 is positioned higher than the liquid surface in the tank 2, and a height difference h1 between the liquid surface in the tank 2 and the branching section 4 is smaller than the potential liquid lifting height h0 by the air pump 10. One end portion of the air supply pipe 5 is connected to the branching section 4, and the other end portion 5*a* of the air supply pipe 5 stands upright. An upper end of the air supply pipe 5 is opened to the outside air, and an air valve 6 that can be opened/closed is attached to an upper end portion thereof. Any valve that is capable of being opened/closed in a short time can be used as the air valve 6; that is, an active valve such as an electromagnetic valve, a passive valve such as a check valve, or the like can be used. In the case where an electromagnetic valve is used, the air pump 10 and the air valve 6 are connected to a control unit (not shown) and controlled in accordance with an operational sequence, which will be explained later.

The other end portion (upright section) 5*a* of the air supply pipe 5 may extend up to a position which is higher than the potential liquid lifting height h0 of the air pump 10, and the air valve 6 may be attached at a position of the upright section 5*a* of the air supply pipe 5 which is higher than the potential liquid lifting height h0 of the air pump 10. In other words, a height difference h3 between the liquid surface and the air valve 6 may be greater than the potential liquid lifting height h0. By providing the air valve 6 at a higher position in this manner, the liquid can be prevented from making contact with the air valve 6 even if the liquid rises upward in the air supply pipe 5. The attachment position of the air valve 6 need not be higher than the potential liquid lifting height h0.

A liquid storage section 7, which is positioned below the branching section 4, is formed in a portion of the liquid lifting pipe 3 between the liquid delivery port 3*b* in the other end of the liquid lifting pipe 3 and the branching section 4. The liquid storage section 7 of the present embodiment is formed of a pipe that is bent forming a U shape, and configured of a downward-facing segment 7*a*, a horizontal segment 7*b*, and an upward-facing segment 7*c*. However, the pipe is not limited to the above-described shape, and can be arbitrarily shaped; for example, the pipe may be curved forming a U shape, an S shape, a spiral shape, or the like. It is sufficient that the liquid storage section 7 is a pipe line having a cross-sectional shape which makes it possible to seal the whole liquid. The cross-sectional shape of the liquid storage section 7 may be the same as that of the liquid lifting pipe 3.

As a condition for lifting the liquid, it is necessary for a volume of the liquid storage section 7 to be smaller than a product of a cross-sectional area of the liquid lifting pipe 3 and the potential liquid lifting height h0 of the air pump. That is;

$$(\text{Volume of Liquid Storage Section}) < (\text{Cross-Sectional Area of Liquid Lifting Pipe}) \times h0$$

By setting the volume of the liquid storage section 7 to be smaller than a product of the cross-sectional area of the liquid lifting pipe 3 and the potential liquid lifting height h0 as discussed above, the liquid in the liquid storage section 7 can be discharged with certainty through the liquid delivery port 3*b* in the case where the air pump 10 is driven and the liquid surface rises up to the potential liquid lifting height h0. The above-discussed relation holds in a case of the cross-sectional area of the liquid lifting pipe 3 being constant. If the relation is generalized so as to include a case in which the cross-sectional area of the liquid lifting pipe 3 is changed, the following formula can be given.

$$\text{Volume of Liquid Storage Section} < \int_{h_L}^{h_L+h0} A(h)dh \qquad \text{[Math. 1]}$$

Here, $h_L$ is an arbitrary liquid surface height in the liquid lifting pipe 3, and A(h) is a cross-sectional area of the liquid lifting pipe 3 at a liquid surface height h. This formula represents a condition under which all the liquid in the liquid storage section 7 can exit from the liquid storage section 7 and rise upward in the liquid lifting pipe 3.

The first driving of the air pump 10 only makes the liquid be stored in the liquid storage section 7. In order to discharge the liquid from the second driving thereof, the following condition may be set and satisfied.

$$\text{Volume of Air Layer} > (\text{Cross-Sectional Area of Liquid Lifting Pipe}) \times (h2 - h0)$$

Figure 3A:
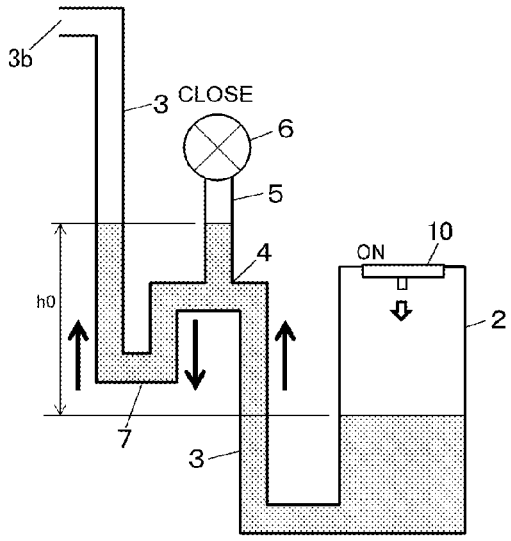
FIGS. 3A-3D include diagrams illustrating an example of operation of a liquid lifting device in the first embodiment.
Figure 3B:
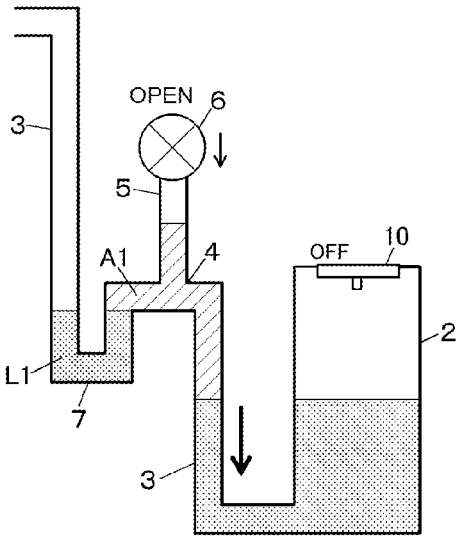

The volume of the air layer refers to a volume of the air, as indicated by hatched lines in FIG. 3B to be explained later, that is introduced by opening the air valve 6. At a stage where the air layer is introduced into the branching section 4 through the air supply pipe 5, by making the volume of the air layer larger than a product of the cross-sectional area of the liquid lifting pipe 3 and a value of (h2−h0), the liquid can be continuously discharged from the second driving of the air pump 10. In the case where the above condition is not satisfied, the liquid can be continuously discharged by performing no less than three times the driving of the air pump 10.

In the case where density of the liquid is taken as p, a maximum discharge pressure generated by the air pump 10 is taken as P, and the acceleration of gravity is taken as g, the potential liquid lifting height h0 by the air pump 10 can be given by the following formula.

$$h0 = P/\rho g$$

As such, in the case where, for example, the liquid is water and the maximum discharge pressure generated by the air pump is 2 kPa, the potential liquid lifting height h0 is approximately 20 cm.

In this case, it is possible to discharge the liquid through the liquid delivery port 3*b* when the height difference h1 between the liquid surface in the tank 2 and the branching section 4 is 15 cm, the height h2 between the liquid surface and the liquid delivery port 3*b* is 25 cm, the height difference h3 between the liquid surface and the air valve 6 is 25 cm, an inner diameter of the liquid lifting pipe 3 (including the liquid storage section 7) is 6 mmϕ, an inner diameter of the air supply pipe 5 is 6 mmϕ, the height of the tank 2 is 10 cm, and an inner diameter of the tank 2 is 10 cmϕ, for example.

Figure 2:
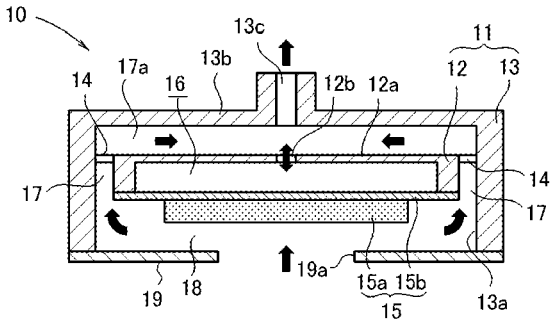
FIG. 2 is a cross-sectional view of a piezoelectric micro blower as an example of an air pump.

Although any existing pressure pump may be used as the air pump 10, a piezoelectric micro blower with a discharge outlet being connected to the interior of the tank 2 and a suction inlet being opened to the outside air is employed in the present embodiment. This piezoelectric micro blower 10 is the same as the piezoelectric micro blower disclosed in Japanese Unexamined Patent Application Publication No. 2011-27079, for example. An example of a structure of the piezoelectric micro blower is illustrated in FIG. 2. As shown in FIG. 2, a blower main body 11 includes an inner case 12 and an outer case 13 that covers an outer side portion of the inner case 12 in a contactless manner with a predetermined gap therebetween. The inner case 12 is held inside the outer case 13 with the predetermined gap therebetween, and is elastically supported with respect to the outer case 13 via a spring coupling unit 14. With this, in the case where the inner case 12 vibrates in the up-down direction along with resonance driving of a vibration plate 15 to be explained later, the vibration thereof is suppressed from being leaked to the outer case 13. An air inflow path 17 is formed between the inner case 12 and the outer case 13.

The inner case 12 is formed in a shape whose cross-section is a rectangle with one side open so that the lower side of the inner case 12 is opened, the vibration plate 15 is fixed so as to close the opening of the inner case 12, and a first blower chamber 16 is formed between the inner case 12 and the vibration plate 15. The vibration plate 15 has a unimorph structure in which, for example, a piezoelectric element 15*a* formed of piezoelectric ceramics is attached to a central portion of a diaphragm 15*b* formed of a thin elastic metal plate. By applying a voltage of a predetermined frequency to the piezoelectric element 15*a*, the overall vibration plate 15 is resonance-driven in a bending mode. In this example, the piezoelectric element 15*a* is fixed to a surface of the diaphragm 15*b* on the opposite side to the first blower chamber.

A first wall 12*a* is provided on a section of the inner case 12 that forms one wall surface of the first blower chamber 16 and opposes the vibration plate 15. In the case where the first wall 12*a* is formed of a thin elastic metal plate and the vibration plate 15 is resonance-driven in a predetermined mode, the first wall 12*a* may be configured so as to be excited along with the resonance-driving of the vibration plate 15. In a section of the first wall 12*a* opposing a central portion of the vibration plate 15, there is formed a first opening 12*b* that allows the interior of the first blower chamber 16 and the exterior thereof to communicate with each other. A second wall 13*b* is provided on a section of the outer case 13 that opposes the first wall 12*a*. A second opening 13*c* is formed in a central portion of the second wall 13*b*, that is, in a portion of the second wall 13*b* opposing the first opening 12*b*. The second opening 13*c* serves as the air discharge outlet. A predetermined inflow space 17*a* is formed between the first wall 12*a* and the second wall 13*b*, and this inflow space 17*a* configures a part of the above-mentioned inflow path 17. The inflow space 17*a* has a function to guide the air having been introduced through the inflow path 17 to the vicinity of the first opening 12*b* as well as the second opening 13*c*.

A third wall 19 is provided on the lower surface side of the outer case 13, more specifically, on the opposite side thereof to the first blower chamber 16 with the vibration plate 15 interposed therebetween so as to form a second blower chamber 18 between the vibration plate 15 and the stated third wall 19. In a central portion of the third wall 19, there is formed a third opening 19*a* that allows the exterior to communicated with the second blower chamber 18. The third opening 19*a* serves as the air suction inlet. The volume of the second blower chamber 18 and an opening area of the third opening 19*a* are so set as to form a pseudo resonance space along with the vibration of the vibration plate 15. The second blower chamber 18 and the inflow path 17 are connected to each other. This causes the air having been introduced into the second blower chamber 18 through the third opening 19*a* to be supplied to the inflow space 17*a* passing through the inflow path 17.

Applying a voltage of a predetermined frequency to the piezoelectric element 15*a* causes the vibration plate 15 to be resonance-driven in a first or third resonant mode, which periodically changes the volume of the first blower chamber 16. The air within the inflow space 17*a* is sucked into the first blower chamber 16 passing through the first opening 12*b* when the volume of the first blower chamber 16 increases; in contrast, when the volume of the first blower chamber 16 decreases, the air in the first blower chamber 16 is discharged into the inflow space 17*a* passing through the first opening 12*b*. Because the vibration plate 15 is driven at a high frequency, the air flow of high speed and high energy discharged into the inflow space 17*a* through the first opening 12*b* passes the inflow space 17*a* and is discharged through the second opening 13*c*. At this time, the above air flow is discharged while sucking peripheral air within the inflow space 17*a*. This generates a continuous air flow moving from the inflow path 17 toward the inflow space 17*a* so that the air is continuously discharged as a jet flow through the second opening 13*c*. Each air flow is indicated by an arrow in FIG. 2. In particular, by exciting the first wall 12*a* along with the resonance-driving of the vibration plate 15, a discharged amount of air can be remarkably increased.

Because the micro blower (air pump) 10 having the above-discussed structure is not equipped with a check valve, the suction inlet 19*a* and the discharge outlet 13*c* communicate with each other when the pump is not driven. As such, when the driving of the air pump 10 is stopped, the interior of the tank 2 instantaneously returns to a state under the atmospheric pressure so that liquid in the liquid lifting pipe 3 can be returned to the tank 2 and the liquid in the lifting pipe 3 can be consequently divided by the air layer. As a result, the next liquid lifting operation can be started in a short time.

Explanation of Operations

Next, an example of operation of the liquid lifting device 1 having the above-discussed structure will be described with reference to FIGS. 3A-3D. First, in the case where the air pump 10 is driven with the air valve 6 being closed (or opened), the interior of the tank 2 is pressurized so that liquid is sent out to the liquid lifting pipe 3 which is connected to the tank 2. This raises a liquid surface in the liquid lifting pipe 3 up to the potential liquid lifting height h0 by the air pump 10. In other words, the liquid surface rises up to a position higher than the branching section 4 so that the liquid is stored in the liquid storage section 7. However, the liquid surface cannot reach the liquid delivery port 3*b*. At this time, part of the liquid also enters the air supply pipe 5 passing through the branching section 4; however, air pressure inside the air supply pipe 5 is raised due to the rise of the liquid surface because the air valve 6 is closed, so that the liquid surface cannot rise up to a position where the air valve 6 is provided. In the case where the air valve 6 is opened, although the liquid surface in the air supply pipe 5 further rises, the liquid will not make contact with the air valve 6 because the air valve 6 is set at a position higher than the potential liquid lifting height h0. This state is shown in FIG. 3A. In FIG. 3A, for facilitating the understanding of operation, a state in which a liquid surface in the tank 2 is lowered in comparison with the case of the pump being not driven is illustrated, but in reality, the liquid surface is hardly lowered.

Subsequently, in the case where the air pump 10 is stopped and the air valve 6 is opened, the interior of the tank 2 returns to a state under the atmospheric pressure and at the same time the outside air is introduced into the branching section 4 passing through the air supply pipe 5. An air layer A1 having been introduced (indicated by hatched lines) pushes down the liquid in the liquid lifting pipe 3 so that most of the liquid returns to the liquid lifting tank 2. In this case, the liquid having been stored in the liquid storage section 7 cannot flow over the height of the branching section 4 and remains in the liquid storage section 7. FIG. 3B shows a state where a liquid column L1 in a predetermined amount is left in the liquid storage section 7.

Figure 3C:
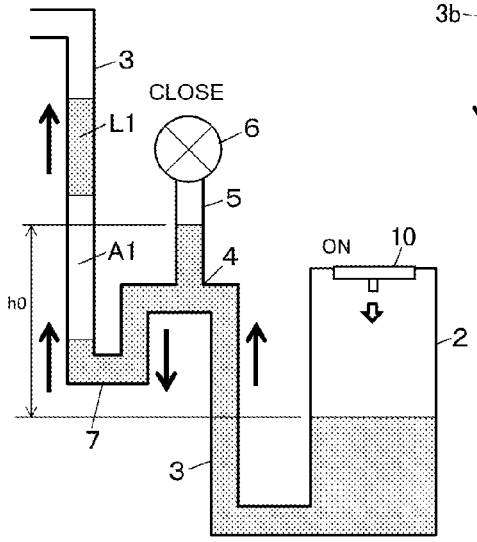

Next, in the case where the air valve 6 is closed and the air pump 10 is driven again, because the air layer A1 within the liquid lifting pipe 3 is pushed by the liquid that has been pushed out of the tank 2, the liquid column L1 left in the liquid storage section 7 is pushed up toward the liquid delivery port 3*b* side via the air layer A1. FIG. 3C shows an intermediate state of liquid lifting operation, where part of the liquid having been pushed out of the tank 2 flows into the air supply pipe 5 through the branching section 4 and the liquid surface in the air supply pipe 5 substantially reaches h0; however the liquid surface of the liquid having flowed into the liquid storage section 7 has not reached h0 yet.

Figure 3D:
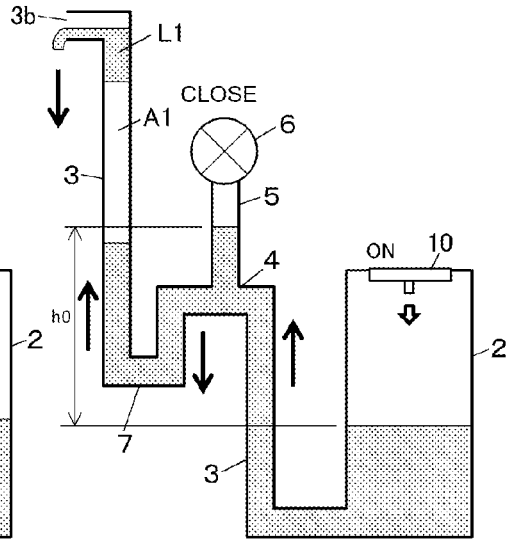

Further, in the case where the air pump 10 is kept driven, the liquid surface in the liquid lifting pipe 3 on the liquid delivery port side rises up close to h0, and the liquid column L1 is pushed via the air layer A1 to be discharged through the liquid delivery port 3*b*. This state is shown in FIG. 3D. after the state shown in FIG. 3D, when the air valve 6 is opened and the air pump 10 is stopped, the operation returns to the state of FIG. 3B. Thereafter, by repeating the same operational sequence as described above, the liquid can be continuously discharged along with the driving of the air pump 10. In the manner described thus far, the liquid can be lifted up to a position higher than the maximum liquid lifting height h0 of the air pump 10.

Figure 4:
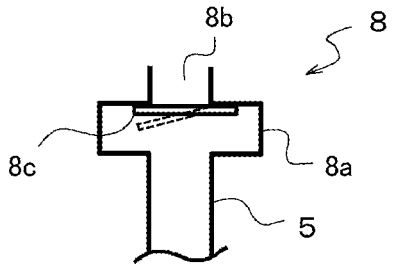
FIG. 4 is a diagram illustrating a structure of a check valve as an example of an air valve.

FIG. 4 shows another embodiment of an air valve. In the above embodiment, although the electromagnetic valve 6 is used as an air valve, a check valve 8 as shown in FIG. 4 can be used instead. In the check valve 8, a valve box 8*a* is formed on an upper end portion of the air supply pipe 5, an opening 8*b* is formed in the upper side of the valve box 8*a*, and a valve body 8*c* formed of a spring plate and configured to close the opening 8*b* from the inside of the box is attached. In other words, the check valve 8 is a check valve that only allows an air flow from the exterior into the air supply pipe 5.

In the case where the above-described check valve 8 is used, because the valve body 8*c* automatically opens (indicated by a broken line in FIG. 4) due to a negative pressure in the air supply pipe 5 resulting from the air pump 10 being stopped (see FIG. 3B), valve control is not necessary and the structure is consequently simplified. The structure of the check valve 8 is not limited to the structure shown in FIG. 4 where the valve body 8*c* formed of a spring plate is used, and a structure using a valve body which is formed in a ball shape may be employed; that is, the structure of the valve can be arbitrarily selected.

Second Embodiment

Figure 5:
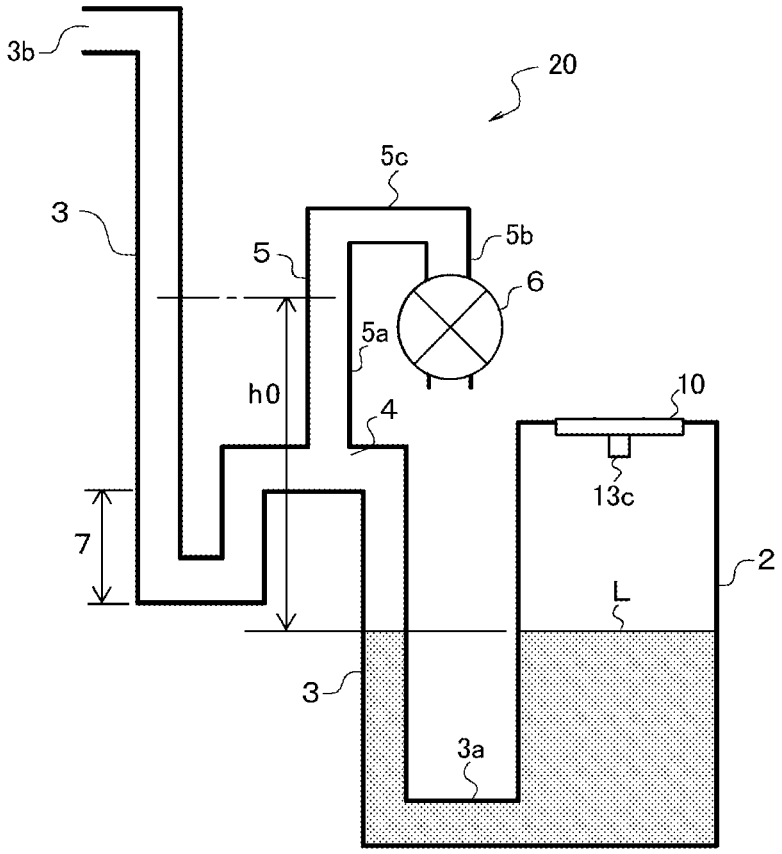
FIG. 5 is a schematic diagram illustrating a second embodiment of a pressurized liquid lifting device according to the present disclosure.

FIG. 5 shows a second embodiment of a pressurized liquid lifting device according to the present disclosure. In the embodiment shown in FIG. 1, the other end portion 5*a* of the air supply pipe 5 stands upright, and the air valve 6 is attached to the leading end portion thereof. However, in the present embodiment, the other end side 5*a* of the air supply pipe 5 is made to stand upright and then is bent so as to face the lower side; thereafter, the air valve 6 is attached to a downward-facing segment 5*b* thereof. In this case, if a top segment 5*c* of the bent portion of the air supply pipe 5 is positioned higher than the potential liquid lifting height h0 by the air pump 10, the liquid cannot flow over the top segment 5*c*. Accordingly, the air valve 6 will not make contact with the liquid even if the air valve 6 is attached at a position lower than the potential liquid lifting height h0. The air supply pipe 5 is not limited to the shape which is bent forming a rectangle as shown in FIG. 5, and the pipe may be curved forming an inverted U shape.

Third Embodiment

Figure 6:
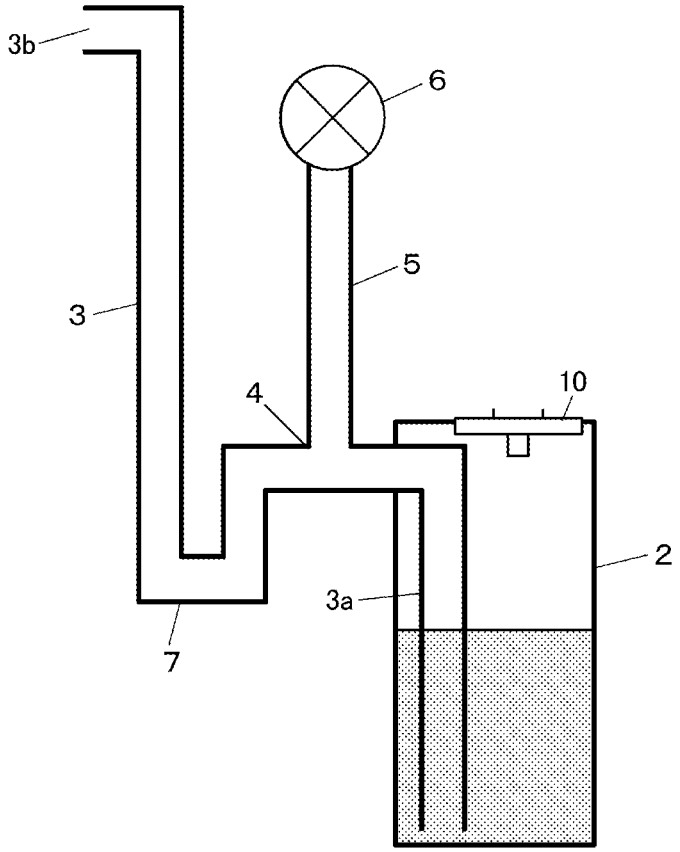
FIG. 6 is a schematic diagram illustrating a third embodiment of a pressurized liquid lifting device according to the present disclosure.

In the embodiments shown in FIG. 1 and FIG. 5, respectively, although the structure in which the one end 3*a* of the liquid lifting pipe 3 is connected to the bottom portion of the liquid lifting tank 2 is described, the disclosure is not limited thereto. For example, as shown in FIG. 6, the structure may be such that the one end portion 3*a* of the air supply pipe 3 is inserted into the interior of the liquid lifting tank 2 and hangs down to the vicinity of the bottom portion of the liquid lifting tank 2. In this case, because part of the liquid lifting pipe 3 is disposed inside the liquid lifting tank 2, the space occupied by the liquid lifting pipe 3 can be reduced, whereby the liquid lifting device can be miniaturized.

Fourth Embodiment

Figure 7:
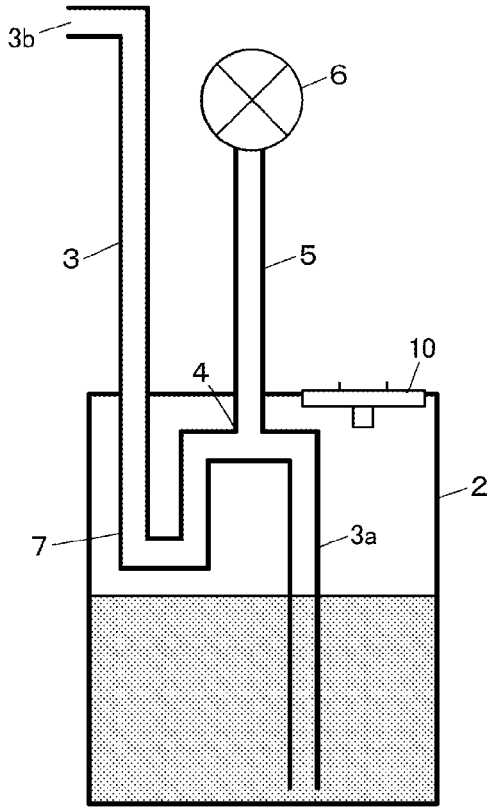
FIG. 7 is a schematic diagram illustrating a fourth embodiment of a pressurized liquid lifting device according to the present disclosure.
Figure 8:
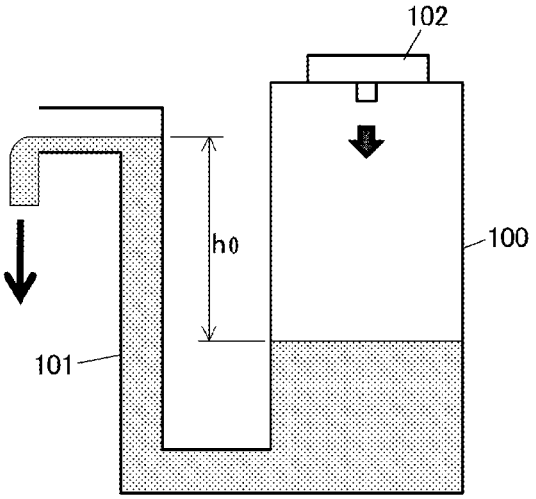
FIG. 8 is a schematic diagram illustrating an example of an existing pressurized liquid lifting device.

Further, as shown in FIG. 7, the structure may be such that only the upper end portion of the air supply pipe 5, the air valve 6, and the other end portion 3*b* of the liquid lifting pipe 3 on the liquid delivery port side are projected to the exterior of the tank 2, while the one end portion 3*a* of the liquid lifting pipe 3, the branching section 4, and the liquid storage section 7 are disposed inside the tank 2. In this case, because the most part of the liquid lifting pipe 3 is disposed inside the tank 2, the configuration of the device can be further miniaturized. In FIG. 7, the volume of the tank 2 is depicted in an enlarged manner in comparison with the first and second embodiments (FIG. 1, FIG. 5). However, the cross-sectional area of the actual liquid lifting pipe 3 is significantly smaller than the cross-sectional area of the tank 2. As such, the volume of the tank 2 can be made equivalent to the volumes thereof in the first and third embodiments.

REFERENCE SIGNS LIST

1 liquid lifting device
2 liquid lifting tank
3 liquid lifting pipe
3*b* liquid delivery port
4 branching section
5 air supply pipe
6 air valve
7 liquid storage section
10 air pump (micro blower)
13*c* discharge outlet
19*a* suction inlet

The invention claimed is:

1. A pressurized liquid lifting device comprising:

a liquid lifting tank that has an airtight structure and stores liquid;

an air pump that pressurizes an interior of the liquid lifting tank;

a liquid lifting pipe of which one end communicates with the liquid in the liquid lifting tank and the other end portion stands upright, wherein a liquid delivery port is provided in a leading end of the other end portion, and a height from a liquid surface in the liquid lifting tank to the liquid delivery port is larger than a potential liquid lifting height of the air pump;

an air supply pipe of which one end portion is connected to a branching section provided at a position halfway in the liquid lifting pipe, wherein an upright section which stands upright is provided between the one end portion of the air supply pipe and the air supply pipe's other end portion an air valve that is provided on the other end portion of the air supply pipe and that is configured to open/close with respect to outside air; and a liquid storage section that is provided in the liquid lifting pipe at a position between the liquid delivery port and the branching section, positioned below the branching section and configured to store a predetermined amount of liquid, wherein the branching section is provided at a position that is higher than the height of the liquid surface in the liquid lifting tank and lower than the potential liquid lifting height of the air pump.

2. The pressurized liquid lifting device according to claim 1, wherein the upright section of the air supply pipe extends up to a position higher than the potential liquid lifting height of the air pump, and the air valve is attached to the upright section of the air supply pipe at a position higher than the potential liquid lifting height of the air pump.

3. The pressurized liquid lifting device according to claim 1, wherein the air valve is a check valve that only allows an airflow from outside air into the air supply pipe.

4. The pressurized liquid lifting device according to claim 1, wherein a volume of the liquid storage section is smaller than a product of a cross-sectional area of the liquid lifting pipe and the potential liquid lifting height of the air pump.

5. A liquid lifting method that uses a pressurized liquid lifting device, the device includes:

a liquid lifting tank that has an airtight structure and stores liquid;

an air pump that pressurizes an interior of the liquid lifting tank;

a liquid lifting pipe of which one end communicates with the liquid in the liquid lifting tank and the other end portion stands upright, wherein a liquid delivery port is provided in a leading end of the other end portion, and a height from a liquid surface in the liquid lifting tank to the liquid delivery port is larger than a potential liquid lifting height of the air pump;

an air supply pipe of which one end portion is connected to a branching section provided at a position halfway in the liquid lifting pipe, wherein an upright section which stands upright is provided between the one end portion of the air supply pipe and the air supply pipe's other end portion an air valve that is provided on the other end portion of the air supply pipe and that is configured to open/close with respect to outside air; and a liquid storage section that is provided in the liquid lifting pipe at a position between the liquid delivery port and the branching section, positioned below the branching section and configured to store a predetermined amount of liquid, wherein the branching section is provided at a position that is higher than the height of the liquid surface in the liquid lifting tank and lower than the potential liquid lifting height of the air pump, the method comprising:

a first step of driving the air pump, lifting the liquid in the liquid lifting tank up to a position higher than the branching section in the liquid lifting pipe, and storing the liquid in the liquid storage section;

a second step of stopping the air pump and opening the air valve, introducing an air layer into the branching section via the air supply pipe, and dividing the liquid in the liquid lifting pipe by the air layer into liquid in the liquid storage section and liquid on a side of the tank relative to the branching section; and a third step of driving the air pump and closing the air valve, and sending the liquid in the liquid lifting tank out to the liquid lifting pipe so that the liquid in the liquid storage section is pushed upward by the air layer to be discharged through the liquid delivery port of the liquid lifting pipe.

6. The liquid lifting method according to claim 5, wherein a volume of the air layer that is provided in the second step is larger than a product of a cross-sectional area of the liquid lifting pipe and a value obtained by subtracting the potential liquid lifting height of the air pump from a difference in height between the liquid delivery port of the liquid lifting pipe and the liquid surface in the liquid lifting tank.

* * * * *